US009864306B2

(12) United States Patent
Ueno et al.

(10) Patent No.: US 9,864,306 B2
(45) Date of Patent: Jan. 9, 2018

(54) IMAGE FORMING APPARATUS WITH CLEANING BLADE

(71) Applicant: CANON KABUSHIKI KAISHA, Tokyo (JP)

(72) Inventors: Takashi Ueno, Tokyo (JP); Motohiro Ogura, Kashiwa (JP); Shozo Aiba, Tsukubamirai (JP); Kengo Sato, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/332,154

(22) Filed: Oct. 24, 2016

(65) Prior Publication Data

US 2017/0115608 A1 Apr. 27, 2017

(30) Foreign Application Priority Data

Oct. 26, 2015 (JP) ..... 2015-209894

(51) Int. Cl.
*G03G 15/16* (2006.01)

(52) U.S. Cl.
CPC ..... *G03G 15/161* (2013.01)

(58) Field of Classification Search
CPC ..... G03G 15/161
USPC ..... 399/101, 350, 351
See application file for complete search history.

(56) References Cited

U.S. PATENT DOCUMENTS

| | | | |
|---|---|---|---|
| 7,289,759 | B2 | 10/2007 | Ogura |
| 7,343,133 | B2 | 3/2008 | Ueno |
| 7,764,917 | B2 | 7/2010 | Ueno |
| 8,095,060 | B2 | 1/2012 | Kiuchi et al. |
| 8,953,973 | B2 | 2/2015 | Aiba et al. |
| 9,031,490 | B2 | 5/2015 | Ogura |
| 9,075,371 | B2 | 7/2015 | Ueno |
| 9,098,020 | B2 | 8/2015 | Aiba |
| 2005/0135852 | A1 | 6/2005 | Sekiguchi |
| 2016/0306303 | A1 | 10/2016 | Ueno |

FOREIGN PATENT DOCUMENTS

| | | | | |
|---|---|---|---|---|
| JP | 59049574 | A * | 3/1984 | ..... G03G 21/0005 |
| JP | 2002-214991 | A | 7/2002 | |
| JP | 2005-025162 | A | 1/2005 | |
| JP | 2009-098254 | A | 5/2009 | |
| JP | 2015-079076 | A | 4/2015 | |

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes a rotatable image drum for carrying a toner image; a transfer member contacted to the drum to transfer the toner image from the drum onto a transfer member; a cleaning blade provided downstream of the transfer member with respect to a peripheral moving direction of the drum and having a free end portion contacted to the drum, the blade being configured to remove, with rotation of the drum, toner remaining on the drum after transfer of the toner image by the transfer member; and a toner retaining member cooperative with the drum to provide a toner accommodation space toner removed from the drum by the blade. The toner retaining member can retain a part of the toner accommodated in the toner accommodation space and capable of being deformed by the toner accommodated in the accommodation space to discharge the toner from the accommodation space.

7 Claims, 5 Drawing Sheets

(a)

(b)

IMAGE FORMING APPARATUS WITH CLEANING BLADE

FIELD OF THE INVENTION AND RELATED ART

The present invention relates to an image forming apparatus, such as a printer, a copying machine, a facsimile machine, and a multifunction image forming machine, which uses electrophotographic technologies.

An image forming apparatus which uses an electrophotographic technology makes its photosensitive drum (or intermediary transfer belt or the like) bear a toner image, and then, transfers the toner image onto a sheet of recording medium from the photosensitive drum. However, it sometimes occurs that a certain amount of toner (which hereafter is referred to as residual toner, or the like) remains on the photosensitive drum after the transfer of the toner image. The residual toner is one of the causes of the occurrence of image defects. Thus, in order to remove the residual toner from the photosensitive drum, an image forming apparatus is provided with a cleaning apparatus (device). One of the well-known devices for cleaning a photosensitive drum is a cleaning device of the so-called blade type, which employs a cleaning blade (which hereafter will be referred to simply as blade), which is placed in contact with the photosensitive drum to scrape down the residual toner from the photosensitive drum.

In recent years, from the standpoint of reducing an image forming apparatus in running cost, it has become a common practice to form a photosensitive drum of a hard substance. With a photosensitive drum being formed of a hard substance, it has become easier for the compounds generated by the electrical discharge, which occurs as a photosensitive drum is charged, to adhere to the photosensitive drum. Once the compounds resulting from the electrical discharge adhere to a photosensitive drum and solidify, not only is it very difficult to remove the compounds from the photosensitive drum with the use of a blade, but also, it is possible that the blade will be damaged by the compounds, instead of removing the compounds. Thus, there have been proposed various cleaning devices which can deal with these issues. One of such cleaning devices is disclosed in Japanese Laid-open Patent Application No. 2009-98254. According to this patent application, the cleaning device is provided with a toner reservoir in which the residual toner removed from the photosensitive drum is stored to be supplied as lubricant and/or abrasive to the cleaning edge portion of the cleaning blade. With a cleaning device being structured as described above, the cleaning edge portion of the cleaning blade is continuously supplied with a fresh supply of residual toner removed from the photosensitive drum. Therefore, the external additives in the residual toner make it easier for the cleaning blade to remove the compounds resulting from the electrical discharge. Therefore, it is less likely for the cleaning blade to be damaged.

However, in the case of the above-described cleaning device disclosed in Japanese Laid-open Patent Application No. 2009-98254, if a substantial amount of residual toner is removed all at once, it is difficult for the toner in the toner reservoir to be discharged. Thus, an excessive amount of removed residual toner collects in the toner reservoir, making it unlikely for the toner in the adjacencies of the cleaning edge of the cleaning blade to be replaced by a fresh supply of removed residual toner. If a situation like the above-described one occurs, the removed residual toner in the adjacencies of the cleaning edge of the cleaning blade agglomerates into a large lump of toner, and lifts the cleaning edge of the cleaning blade away from the peripheral surface of the photosensitive drum, or makes it impossible for the blade to maintain a proper amount of contact pressure between itself and photosensitive drum. Therefore, it is likely for image defects to occur. Further, it becomes difficult for the cleaning edge portion of the cleaning blade to be supplied with the external additives, making it likely for the blade to be damaged.

SUMMARY OF THE INVENTION

According to an aspect of the present invention, there is provided an image forming apparatus comprising a first image bearing member rotatable carrying a toner image; a transfer member contacted to said first image bearing member and configured to transfer the toner image from said first image bearing member onto a second image bearing member; a cleaning blade provided at a position downstream of said transfer member with respect to a peripheral moving direction of said first image bearing member and having a free end portion contacted to said image bearing member, said cleaning blade being configured to remove, with rotation of said first image bearing member, toner remaining on said first image bearing member after transfer of the toner image by said transfer member; and a toner retaining member cooperative with said first image bearing member to provide a toner accommodation space capable of accommodating the toner removed from said first image bearing member by said cleaning blade, said toner retaining member being capable of retaining therein a part of the toner accommodated in the toner accommodation space and capable of being deformed by the toner accommodated in the accommodation space to discharge the toner from said accommodation space.

Further features of the present invention will become apparent from the following description of exemplary embodiments with reference to the attached drawings.

DESCRIPTION OF THE EMBODIMENTS

Embodiment 1

Referring to FIGS. 1-5, the first embodiment of the present invention is described. To begin with, the image forming apparatus in this embodiment is described with reference to FIG. 1.

<Image Forming Apparatus>

Figure 1:
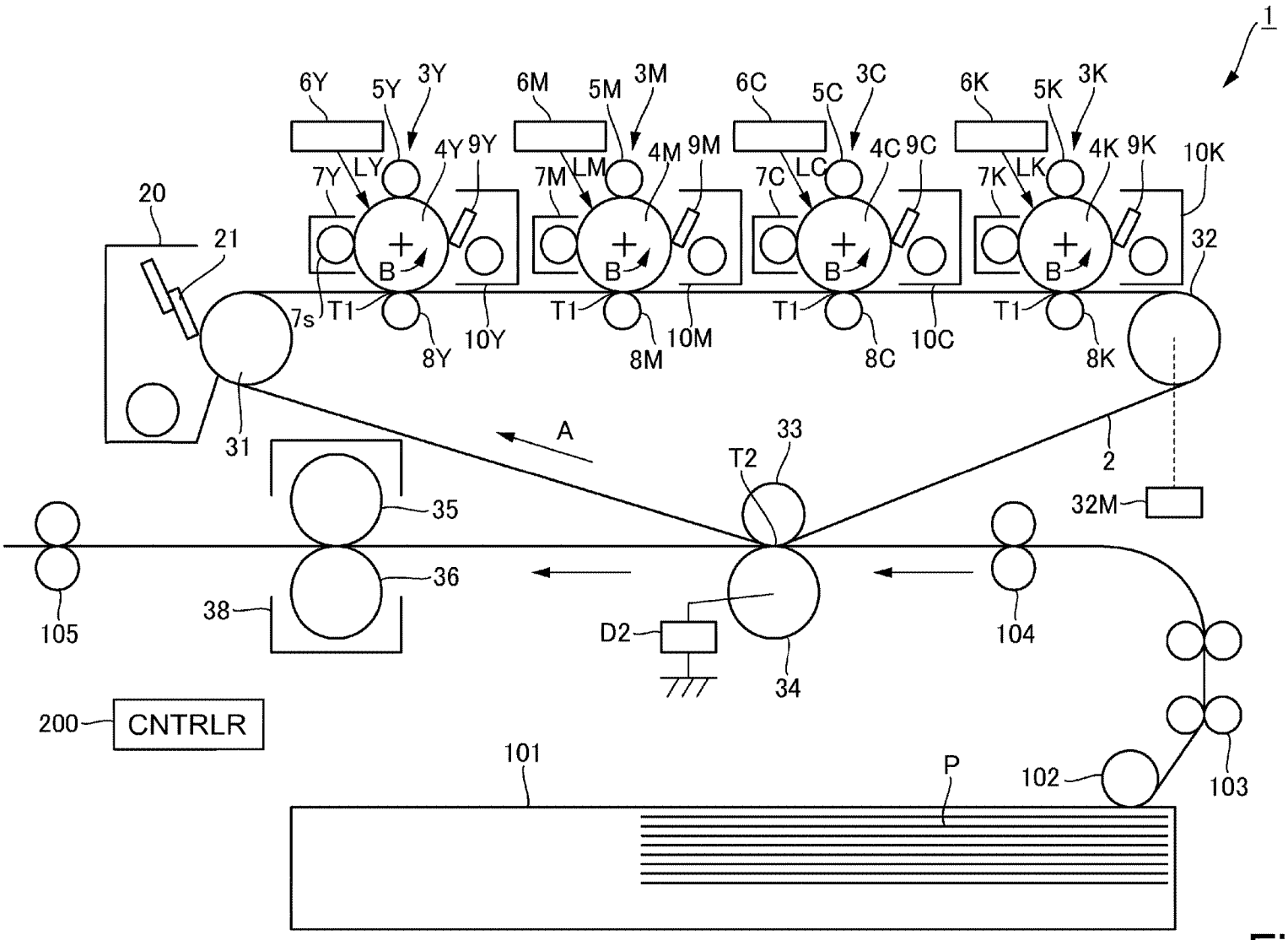
FIG. 1 is a schematic drawing of the image forming apparatus in the first embodiment of the present invention, and shows the structure of the apparatus.

The image forming apparatus 1 shown in FIG. 1 is a full-color printer of the so-called tandem type, and also, of the so-called intermediary transfer type. It has yellow, magenta, cyan and black image forming portions 3Y, 3M, 3C and 3K, respectively, which are in alignment along the intermediary transfer belt 2.

In the image forming station 3Y, a toner image of yellow color is formed on the photosensitive drum 4Y, and is transferred (primary transfer) onto the intermediary transfer belt 2. In the image forming station 3M, a toner image of magenta color is formed on the photosensitive drum 4M, and is transferred (primary transfer) onto the intermediary transfer belt 2 in such a manner that it is laid upon the yellow toner image in the intermediary transfer belt 2. In the image forming station 3C and 3K, toner images of cyan and black colors are formed on the photosensitive drums 4C and 4K, respectively, and are transferred (primary transfer) onto the intermediary transfer belt 2 in such a manner that they are sequentially layered upon the yellow and magenta images on the intermediary transfer belt 2.

After being transferred (primary transfer) onto the intermediary transfer belt 2, the four toner images are conveyed to a secondary transferring portion T2, in which they are transferred together (secondary transfer) onto a sheet P of recording medium (such as paper, OHP film, and the like). The secondary transferring portion T2 is formed by pressing an outward secondary transfer roller 34 toward an inward secondary transfer roller 33, with the placement of the intermediary transfer belt 2 between the two rollers 33 and 34. The outward secondary transfer roller 34 (transferring means) is in connection to a secondary transfer high voltage power source D2, which is variable in the bias (output voltage) it supplies. The inward secondary transfer roller 33 is grounded (0 V in potential). Thus, as positive voltage (secondary transfer bias) which is opposite in polarity from toner is applied to the outward secondary transfer roller 34, an electric filed (transfer electric field) is generated in the secondary transferring portion T2. In response to this transfer electric field, the toner images which have just been transferred (primary transfer) onto the intermediary transfer belt 2, are transferred together (secondary transfer) onto the sheet P of recording medium. The transfer residual toner, that is, the toner which failed to be transferred (secondary transfer) onto the sheet P, being therefore remaining on the intermediary transfer belt 2, is removed by a belt cleaning device 20, which is disposed on the upstream side of the photosensitive drum 4Y in terms of the moving direction of the intermediary transfer belt 2. The belt cleaning device 20 has a cleaning blade 21, which is placed in contact with the intermediary transfer belt 2 to remove the transfer residual toner from the intermediary transfer belt 2, on the downstream side of the secondary transferring portion T2.

The sheets P of recording medium are moved out of a recording medium cassette 101 by a pickup roller 102, and are separated one by one by a pair of separation rollers 103. Then, each sheet P is sent to a pair of registration rollers 104, which sends each sheet P to the secondary transferring portion T2 with such timing that the sheet P arrives at the secondary transferring portion T2 at the same time as the toner images on the intermediary transfer belt 2. Then, the sheet P (image bearing member) is conveyed through the secondary transferring portion T2, remaining pinched between the outward secondary transfer roller 34 and inward secondary transfer roller 33. While the sheet P is conveyed through the secondary transferring portion T2, the toner images are transferred (secondary transfer) onto the sheet P from the intermediary transfer belt 2 as described above. After the secondary transfer, the sheet P is separated from the intermediary transfer belt 2 by the curvature of the intermediary transfer belt 2 (inward secondary transfer roller 33), and is conveyed to a fixing device 38, in which the sheet P and the toner images thereon are heated and pressed by a combination of a heat roller 35 and a pressure roller 36, which the fixing device 38 has. Consequently, the toner images on the sheet P are thermally fixed to the sheet P. After the fixation of the toner images to the sheet P, the sheet P is discharged from the image forming apparatus 1.

Next, the image forming portions 3Y, 3M, 3C and 3K are described. However, they are roughly the same in structure, although they are different in the color (yellow, magenta, cyan and black, respectively) of the toner they use. Therefore, only the image forming portion 3Y is described in detail. The description of the other image forming portions 3 are the same as that of the image forming portion 3Y, except that the suffix Y is replaced with M, C, K, respectively.

The image forming portion 3Y is structured so that the photosensitive drum 4Y is surrounded by a charge roller 5Y, an exposing device 6Y, a developing device 7Y, a primary transfer roller 8Y, and a drum cleaning device 10Y. The photosensitive drum 4Y, which is an image bearing member, is made up of an aluminum cylinder, and a photosensitive layer formed on the peripheral surface of the aluminum cylinder, as will be described later in detail (with reference to FIG. 2). It is rotated in the preset direction (indicated by arrow mark B in FIG. 1) at a preset process speed. The charge roller 5Y charges the photosensitive drum 4Y. More specifically, as oscillatory voltage, which is a combination of negative DC voltage and AC voltage, is applied to the charge roller 5Y, the peripheral surface of the photosensitive drum 4Y is uniformly charged to the preset negative potential level (pre-exposure potential level). The exposing device 6Y writes an electrostatic latent image on the uniformly charged portion of the peripheral surface of the photosensitive drum 4Y. More specifically, it scans the uniformly charged portion of the peripheral surface of the photosensitive drum 4Y with the beam of laser light it emits, while modulating (turning on or off) the beam, according to the data of the yellow monochromatic image, which corresponds to the yellow component of the image to be formed. The exposing device 6Y may be an analog exposing device which projects (focuses) an optical image of an original onto the peripheral surface of the photosensitive drum 6Y, or a digital exposing device such as a laser scanner, an exposing device made of an LED array, etc.

The developing device 7Y develops the electrostatic latent image into a toner image by supplying the photosensitive drum 4Y with toner. More specifically, the developing device 7Y uses two-component developer (which hereafter will be referred to simply as developer) which contains toner and carrier. It negatively charges the toner by stirring the developer. It has a development sleeve 7*s*, which is disposed so that there is only a minute gap between its peripheral surface and the peripheral surface of the photosensitive drum 4Y. The development sleeve 7*s* is rotated in such direction that in the area in which the distance between its peripheral surface and the peripheral surface of the photosensitive drum 4Y is smallest, its peripheral surface moves in the opposite direction of the peripheral surface of the photosensitive drum 4Y. The development sleeve 7*s* internally holds a magnetic member 7*m*. Thus, the charged developer is magnetically held to the development sleeve 7*s*, and is conveyed to the area in which the peripheral surface of the development sleeve 7*s* opposes the peripheral surface of the photosensitive drum 4Y. In this area between the development sleeve 7*s* and photosensitive drum 4Y, the developer is made to crest, and therefore, it rubs the peripheral surface of the photosensitive drum 4Y. Thus, as the aforementioned oscillatory voltage, which is a combination of negative DC voltage and AC voltage, is applied to the development sleeve 7*s*, the negatively charged toner is made to transfer from the development sleeve 7*s* onto the exposed points of the peripheral surface of the photosensitive drum 4Y, which have been made positive in polarity, relative to the toner, by the exposure. That is, the electrostatic latent image is developed in reverse. By the way, the developing devices 7M, 7C and 7K also have their own development sleeve 7*s*.

The primary transfer roller 8Y, which is a transferring means, forms a primary transferring portion T1, between the photosensitive drum 4Y and intermediary transfer belt 2, by pressing the intermediary transfer belt 2. As the primary transfer bias voltage, which is positive in polarity, is applied to the primary transfer roller 8Y, the negatively charged toner image is transferred (primary transfer) from the photosensitive drum 4Y onto the intermediary transfer belt 2. However, a certain amount of toner in the toner images fails to be transferred in the primary transfer portion T1, and moves through the primary transferring portion T1, remaining on the photosensitive drum 4Y, on the downstream side of the primary transferring portion T1. Thus, the image forming apparatus 1 is provided with the drum cleaning device 10Y which has a cleaning blade 9Y. The drum cleaning device 10 removes the toner (residual toner) remaining on the photosensitive drum 4Y after the completion of the secondary transfer, by placing the cleaning blade 9Y in contact with the photosensitive drum 4Y.

<Intermediary Transfer Belt>

The intermediary transfer belt 2, which is an image bearing member, is supported by a combination of a tension roller 31, a driver roller 32, and the inward secondary transfer roller 33 in such a manner that the belt bridges between the adjacent two rollers. It is rotationally driven at the preset process speed in the preset direction (indicated by arrow mark A in FIG. 1) by the driver roller 32. The tension roller 31 provides the intermediary transfer belt 2 with a preset amount of tension. The driver roller 32 is driven by an intermediary transfer belt driving motor 32M, which is a driving means. The intermediary transfer belt 2 is a single-layer belt. It is recommendable that the intermediary transfer belt 2 is formed of a resinous substance such as a copolymer of polyethylene and tetrafluoroethylene, which contains fluorine. More specifically, the intermediary transfer belt 2 is formed of a material created by dispersing carbon black in the base substance so that the resultant belt becomes $1\times10^{12}$ [Ω/□] in surface resistivity, and $1\times10^{9}$ [Ω·cm] in volume resistivity.

<Photosensitive Drum>

Figure 2:
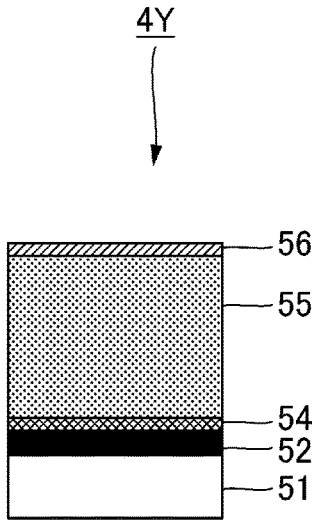
FIG. 2 is a sectional view of one of the photosensitive drums in the image forming apparatus, and shows the structure of the photosensitive drum.

Next, referring to FIG. 2, the photosensitive drum 4Y is described. The photosensitive drum 4Y is made up of an electrically conductive cylindrical substrate 51 formed of aluminum, for example, and four layers, more specifically, an undercoat layer 52, a laminar photosensitive layer made up of sub-layers 54 and 55 (formed of OPC), and a surface protection layer 56, which were layered on the peripheral surface of the substrate 51 as shown in FIG. 2. The undercoat layer 52 covers the peripheral surface of the substrate 51 to improve the photosensitive drum 4Y in terms of the adhesion between the substrate 51 and photoconductive layer, and coat-ability, to protect the conductive substrate 51, to cover the defects of the conductive substrate 51, to improve the photosensitive drum 4Y in terms of the charge injection from the conductive substrate 51, to protect the photosensitive layer formed of OPC from electrical destruction, and the like purposes. The photosensitive layer formed of OPC is made up of a charge generation layer 54 which is formed on the undercoat layer 52 and contains a charge generating substance, and a charge transfer layer 55 which is formed on the charge generation layer 54 and contains a charge transferring substance. There is formed the surface protection layer 56 on the photosensitive layer formed of OPC. By the way, the peripheral surface of the photosensitive drum 4Y, that is, the outward surface of the surface protection layer 56, is abraded by abrasive tape (rapping paper), buffing abrasive, or the like, so that the surface becomes 0.2-2.0μ in ten-point average roughness Rz (JIS B0601-1982).

<Developer>

The developing device 7Y uses two-component developer which contains negatively chargeable toner (nonmagnetic) and positively chargeable magnetic carrier. In the case of the two-component developer used in this embodiment, the weight ratio between the toner and carrier was 9:91. That is, the toner density was 9%. Further, the weight average particle diameter of the toner was 5.7 μm.

The toner contains binding resin (which is sometimes referred to simply as binder), coloring agent, and charge controlling agent. In this embodiment, styrene resin, acrylic resin, or the like, for example, was used as the binding resin. However, this embodiment is not intended to limit the present invention in scope in terms of materials for the binding resin. For example, styrene resin, polyester resin, polyethylene resin, or the like may be used as the binding resin. As the coloring agent, carbon black, dye, pigment, or the like may be individually used, or in combination. As the charge controlling agent, a compound which contains charge controlling agent for reinforcement, may be used as necessary. All that is required of the charge controlling agent is that it contains nigrosine dye, triphenylmethane dye, or the like.

Toner contains wax, which is for improving toner in the separability from the fixing device 38 when a toner image is fixed to a sheet P of recording medium, and in the fix-ability to the sheet P, and/or the like purposes. As the wax, paraffin wax, carnauba wax, poly-olefin wax, or the like, for example, is used. The wax is dispersed into the mixture of the materials for the toner when the mixture is kneaded. In this embodiment, such toner that is obtained by mixing the coloring agent, charge controlling agent, and wax into the bonding resin, and then, mechanically pulverizing the thus obtained resin, is used.

The surface of a toner particle is covered with external additives. As the external additive, microscopic particle of amorphous silica which has been made hydrophobic, inorganic oxide, such as titanium oxide and titanium compounds, or the like, may be used. As these microscopic particles adhere to the surface of a toner particle, toner is adjusted in fluidity, amount of charge, etc. The external additives are desired to be no less than 1 nm and nor more than 100 nm in particle diameter. In this embodiment, titanium oxide which is 50 nm in average particle diameter, amorphous silica which is 2 nm in average particle diameter, and amorphous silica which is 100 nm in average particle diameter, were added as external additives by 0.5 wt. %, 2.5 wt. %, and 1.0 wt. %, respectively, in weight ratio.

As carrier, particles of iron, nickel, cobalt, manganese, chrome, rare-earth metal, their alloys, the surface of which has been oxidized or not oxidized, ferrite oxide, etc., may be preferably used. In this embodiment, carrier obtained by coating ferrite particles with silicon resin was used. It was 24 [$Am^2$/kg] in saturation magnetization in a magnetic field which was 240 [A/m] in strength, $1\times10^7$ [Ω·cm]-$1\times10^8$ [Ω·cm] in specific resistivity in an electric field which was 3000 [V/cm] in strength, and 50 μm in weight average particle diameter.

<Cleaning Device>

Figure 3:
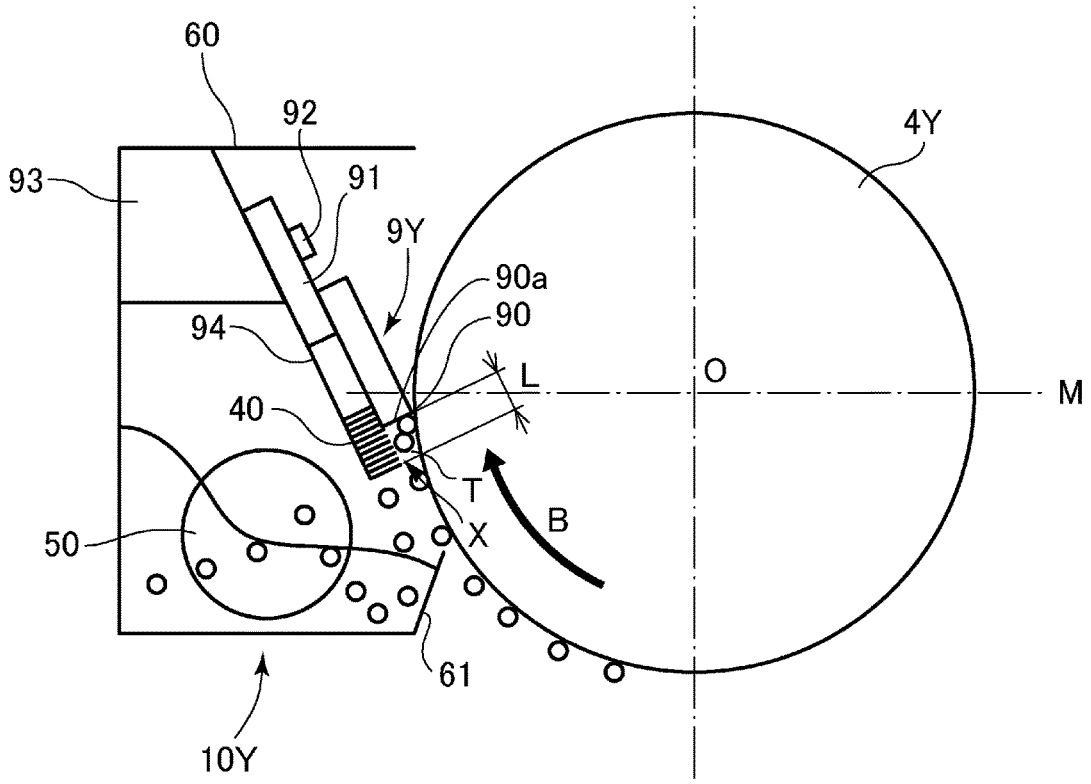
FIG. 3 is a sectional view of the cleaning device in the first embodiment of the present invention.
Figure 4:
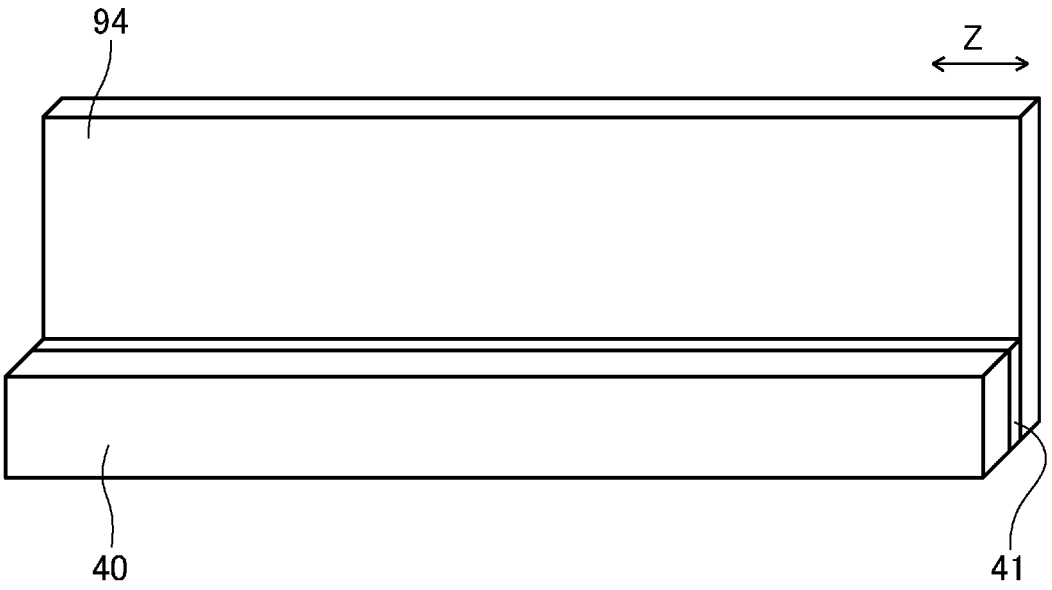
FIG. 4 illustrates a toner retaining member in the first embodiment, with parts (a) and (b) being perspective and side views of the toner retaining member, respectively.
Figure 4:
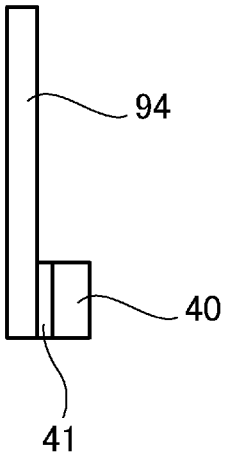
Figure 5:
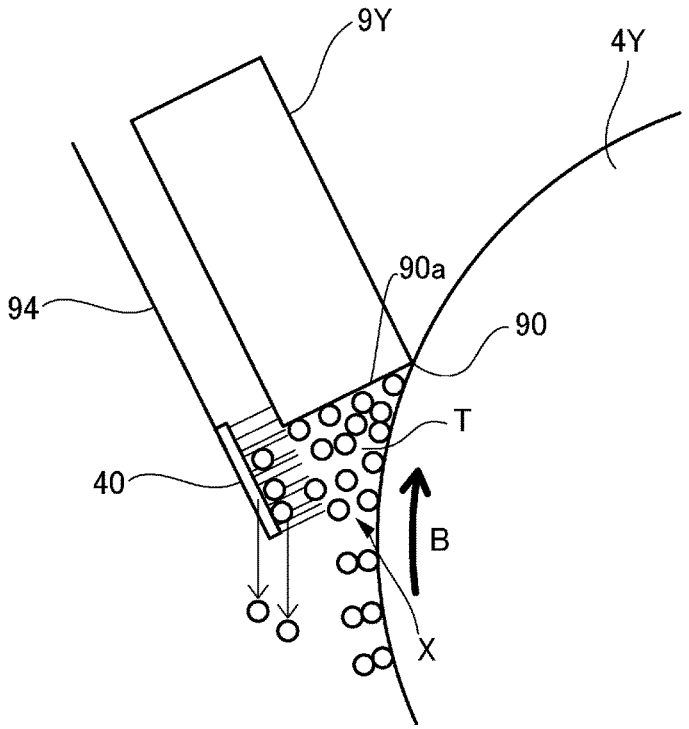
FIG. 5 is a schematic drawing for describing the adjustment of the amount by which toner is retained by the toner retaining member in the first embodiment.

As described above, the image forming apparatus 1 in this embodiment is equipped with drum cleaning devices 10Y-10K, which are for removing the toner particles which failed to be transferred (primary transfer) from the photosensitive drums 4Y-4K, and therefore, are remaining on the photosensitive drums 4Y-4K, respectively. Further, the image forming apparatus 1 is equipped with a belt cleaning device 20 which is for removing the toner particles which failed to be transferred (secondary transfer) from the intermediary transfer belt 2, and therefore, are remaining on the intermediary transfer belt 2. Referring to FIGS. 3-5, these cleaning devices are described. The drum cleaning devices 10Y-10K, and belt cleaning device 20, in this embodiment, are of the so-called blade type. That is, they scrape down the residual toner with the use of cleaning blades (9Y-9K, 21, respectively). Thus, they are described together with reference to the drum cleaning device 10Y.

The drum cleaning device 10Y shown in FIG. 3 has a housing 60. It has also a support 93, a blade supporting metallic plate 91, the cleaning blade 9Y, a sheet 94, and a brush 40, which are disposed in the housing 60. The housing 60 has an opening, and is disposed so that its opening faces the photosensitive drum 4Y. The support 93 is disposed on the top side in the internal space of the housing 60. To the support 93, the blade supporting metallic plate 91 is attached with the use of small screws 92 so that the plate 91 can be adjusted in its position relative to the support 93.

<Cleaning Blade>

To the blade supporting metallic plate 91, the cleaning blade 9Y, which is in the form of a long and narrow rectangle, is attached in contact with the photosensitive drum 4Y in such an attitude that the cleaning edge of the cleaning blade 9Y is on the upstream side of the base portion of the cleaning blade 9Y, in terms of the rotational direction (indicated by arrow mark B in FIG. 3), and also, that the short edges of the cleaning blade 9Y diagonally extend downward toward the opening of the housing 60. In this embodiment, the cleaning blade 9Y is in contact with the photosensitive drum 4Y, on the downstream side of the primary transferring portion T1 (FIG. 1) in which the peripheral surface of the photosensitive drum 4Y moves upward in terms of the gravity direction, in such an attitude that its cleaning edge is on the upstream of its base portion. The amount of contact (contact pressure) between the cleaning blade 9Y and photosensitive drum 4Y can be adjusted by loosening the small screws 92 and moving the blade supporting metallic plate 91 relative to the support 93.

The cleaning blade 9Y is formed of an elastic substance. Since the cleaning blade 9Y is required not to frictionally scar the photosensitive drum 4Y, and also, is required to be highly resistant to friction wear, polyurethane or the like rubber is widely used as the material for the cleaning blade 9Y. In consideration of the fact that the cleaning blade 9Y is required to be small in the amount of residual deformation, it is desired that thermally curable polyurethane of the two-liquid type is used as the material for the cleaning blade 9Y. However, styrene-butadiene copolymer, chloroprene rubber, butadiene rubber, ethylenepropylenediene rubber, chlorosulfonated polyethylene rubber, fluorinated rubber, silicon rubber, or the like may be used. The cleaning blade 9Y is roughly 70-80 in rigidity in Asker C scale. It is 340 mm in width (dimension in terms of direction parallel to rotational axis of photosensitive drum 4Y), 2 mm in thickness, and 15 mm in width (dimension in terms of direction inter-sectional to rotational axis of photosensitive drum 4Y). Further, the distance from the blade supporting metallic plate 91 to the cleaning edge of the cleaning blade 9Y is 8 mm. By the way, in terms of the direction parallel to the rotational axis of the photosensitive drum 4Y, the cleaning blade 9 is greater in dimension than the portion of the peripheral surface of the photosensitive drum 4Y, across which a toner image can be formed.

Further, to the blade supporting metallic plate 91, the sheet 94 is attached, in addition to the cleaning blade 9Y, in such an attitude that it extends downward toward the opening of the housing 60. In this embodiment, the cleaning blade 9Y and sheet 94 are disposed so that they are parallel to each other, with the presence of a preset amount of gap between the cleaning blade 9Y and sheet 94. In a case where the blade supporting metallic plate 91 is moved relative to the support 93, the sheet 94 moves with the blade supporting metallic plate 91, without changing its position relative to the blade supporting metallic plate 91. Further, the unattached edge portion of the sheet 94 is provided with a brush 40. The sheet 94 and brush 40 are described later.

Referring to FIG. 3, the drum cleaning device 10Y is provided with a scatter prevention sheet 61, which is disposed on the upstream side of the opening of the housing 60 in terms of the rotational direction of the photosensitive drum 4Y, in order to cover the gap between the housing 60 and photosensitive drum 4Y. The scatter prevention sheet 61 prevents the problem that as the transfer residual toner is removed from the photosensitive drum 4Y by the cleaning blade 9Y, it leaks out of the housing 60. The scatter prevention sheet 61 is formed of a sheet of polyethyleneterephthalate, or the like, for example, which is roughly 20-50 μm in thickness.

A space which is surrounded by the housing 60 and scatter prevention sheet 61, and is in the bottom portion of the housing 60 in terms of the gravity direction, functions as a storage for storing the primary transfer residual toner as the residual toner is removed from the photosensitive drum 4Y by the cleaning blade 9Y, and falls. There is a conveyance screw 50 in this space. The conveyance screw 50 conveys the toner in the storage to an unshown toner recovery container. That is, as the transfer residual toner is removed from the photosensitive drum 4Y, it is stored in the toner recovery container.

<Sheet>

The sheet 94, which is a supporting member, is formed of a substance which is higher in coefficient of elasticity than the material for the cleaning blade 9Y. Further, it is formed so that it is higher in rigidity than the brush 40. Referring to parts (a) and (b) of FIG. 4, the dimension of the sheet 94 in terms of the direction (indicated by arrow mark Z in part (a) of FIG. 4; widthwise direction) is roughly the same or slightly greater than the dimension of the cleaning blade 9Y in terms of the same direction. As for the thickness of the sheet 94, it is less than that of the cleaning blade 9Y. In this embodiment, the sheet 94 was formed of PET resin (product of Toray Co., Ltd.: Lumirrar (commercial name). Referring to FIG. 3, sheet 94 is disposed roughly in parallel to the cleaning blade 9Y, on the opposite side of the cleaning blade 9Y from the photosensitive drum 4Y, with the presence of the preset amount of gap between itself and cleaning blade 9Y.

<Brush>

Referring to parts (a) and (b) of FIG. 4, the drum cleaning device 10Y is provided with the brush 40, which is adhered to the opposite portion of the sheet 94 from the supporting metallic plate 91, in terms of the direction (perpendicular to long edges of sheet 94) parallel to the shorter edges of the sheet 94, with the use of a piece of two-sided adhesive tape or the like. The brush 40 is provided with numerous strands (bristles) of fine resin fibers. It is lower in rigidity than the cleaning blade 9Y and sheet 94. The bristles of the brush 40 are roughly 20-30, for example, in rigidity in Asker C hardness scale. Further, the bristles of the brush 40 are formed of resin or the like, which tends to become electrostatically charged. The brush 40 used in this embodiment is such a brush that was made by planting numerous straight Nylon bristles, which are 2 mm in length and 0.2 mm in diameter, to the sheet 94, at a density of 50 kF. The brush 40 is capable of retaining toner among its bristles, and also, releasing the toner retained among the bristles. All that is required of the bristles of the brush 40 is that they are relatively flexible (bendable). Further, the finer (higher in density) the bristles, the better. Moreover, the bristle shape does not matter. That is, the bristle shape is optional. For example, they may be semispherical at their tip.

Referring to FIG. 3, the brush 40 is disposed so that its bristles extend toward the photosensitive drum 4Y (image bearing member) without coming into contact with the photosensitive drum 4Y. More specifically, it is disposed so that it extends toward the photosensitive drum 4Y, in parallel to the short edges of the cleaning blade 9Y, by an amount L, which can provide a preset amount (0.2-0.75 mm, for example) of gap between itself and photosensitive drum 4Y. Thus, a toner reservoir T (toner holding area) is created by a combination of the brush 40, the end surface 90*a* of the cleaning blade 9Y, which is closer to the photosensitive drum 4Y, and the peripheral surface of the photosensitive drum 4Y. In this embodiment, however, the toner reservoir T, which is a space in which the residual toner removed from the peripheral surface of the photosensitive drum 4Y is storable, is provided with an opening which opens downward in terms of the gravity direction, at the end surface portion 90*a*.

Further, there is the abovementioned gap between the sheet 94 and cleaning blade 9Y. However, if the removed residual toner enters the gap between the sheet 94 and cleaning blade 9Y as it is scraped down from the peripheral surface of the photosensitive drum 4Y, it presses the cleaning blade 9Y toward the photosensitive drum 4Y, making it possible for the amount of contact (contact pressure) between the cleaning blade 9Y and photosensitive drum 4Y to change by an amount large enough to interfere with the movement of the cleaning blade 9Y, which in turn may make it difficult for the cleaning blade 9Y to reliably clean the photosensitive drum 4Y (remove residual toner from photosensitive drum 4Y).

In this embodiment, therefore, the brush 40 is disposed so that parts of the bristles of the brush 40 are in the gap between the cleaning blade 9Y and sheet 94. That is, the brush 40 is disposed so that it blocks the opening of the toner reservoir (toner storing space) between the cleaning blade 9Y and sheet 94. The brush 40 prevents the removed residual toner from entering the gap between the cleaning blade 9Y and sheet 94 as the residual toner is scraped down. Thus, it is possible for the amount of contact (contact pressure) between the cleaning blade 9Y and photosensitive drum 4Y to be kept stable. Therefore, it is possible for the cleaning blade 9Y to be kept stable in its cleaning performance.

Next, referring to FIG. 5, the drum cleaning device 10Y is described about its function. As the photosensitive drum 4Y is rotated, its peripheral surface is scraped by the cleaning edge 90 of the cleaning blade 9Y. Consequently, the toner remaining on the peripheral surface of the photosensitive drum 4Y is scraped down by the cleaning blade 9Y. As the residual toner on the peripheral surface of the photosensitive drum 4Y is scraped down, it is made to fall straight downward by gravity, and collects in the toner reservoir T.

Here, it is desired that the cleaning blade 9Y is positioned so that the cleaning edge 90 of the cleaning blade 9Y contacts the photosensitive drum 4Y, on the top side (downstream side in terms of rotational direction of photosensitive drum 4Y) of the horizontal straight line M (FIG. 3) which coincides with the rotational axis O of the photosensitive drum 4Y. The reason why the cleaning blade 9Y is desired to be positioned as described above is that if the cleaning blade 9Y is positioned so that its cleaning edge 90 contacts the photosensitive drum 4Y, on the bottom side (upstream side in terms of rotational direction of photosensitive drum 4Y), it becomes difficult for the residual toner to collect in the toner reservoir T as it is removed from the photosensitive drum 4Y, and therefore, it becomes difficult to prevent the cleaning blade 9Y from generating abnormal noises as it scrapes the surface of the photosensitive drum 4Y, and/or to prevent the cleaning blade 9Y from being damaged.

As described above, in this embodiment, the toner reservoir T is open on the bottom side in terms of the gravity direction as described above. However, it can retain the residual toner as the residual toner is scraped down from the photosensitive drum 4Y. That is, the toner particles which are scraped down by the cleaning blade 9Y are the toner particles which are remaining on the peripheral surface of the photosensitive drum 4Y after the primary transfer of a toner image. Therefore, not only have the toner particles been electrostatically charged to the negative polarity, but also, they are likely to adhere to each other. Moreover, the bristles of the brush 40 are likely to rub against each other, and therefore, are likely to be electrostatically charged to the positive polarity. Thus, the negatively charged toner particles are held by the brush 40 while remaining adhered to each other. Consequently, the opening of the toner reservoir is blocked by the agglomerated toner particles. Thus, the removed residual toner particles collect in the reservoir T. As the removed toner collects in the toner reservoir T, it is supplied to the cleaning edge 90 of the cleaning blade 9Y, as lubricant for the cleaning blade 9Y. Thus, the external additives in the toner enter between the cleaning edge 90 and photosensitive drum 4Y, and function as lubricants. In this case, the external additives can remove the byproducts of the electrical discharge, which have adhered to the photosensitive drum 4Y.

As the photosensitive drum 4Y is rotated, the cleaning edge 90 of the cleaning blade 9Y slides along the peripheral surface of the photosensitive drum 4Y in an oscillatory manner in the direction parallel to the rotational direction of the photosensitive drum 4Y. That is, as the photosensitive drum 4Y is rotated, the cleaning edge 90 of the cleaning blade 9Y is gradually pushed back (downstream in terms of rotational direction of photosensitive drum 4Y) by the residual toner on the peripheral surface of the photosensitive drum 4Y, causing thereby the cleaning blade 9Y to elastically deform. Then, as the cleaning edge 90*a* is pushed downstream to a certain position, it is made to spring back by the resiliency of the cleaning blade 9Y, to the position in which it was before it began to be moved downstream. It is as the cleaning edge 90*a* is made to move back to where it was, that the residual toner on the photosensitive drum 4Y is scraped down from the photosensitive drum 4Y by the cleaning edge 90*a*.

As the cleaning edge 90 of the elastically deformed cleaning blade 9Y springs back to where it was before the starting of the elastic deformation of the cleaning blade 9Y, the toner having collected in the toner reservoir T is pressed. In a case where the residual toner which was scraped down from the photosensitive drum 4Y and collected in the toner reservoir T is small in amount, the toner in the toner reservoir T is subjected to a relatively small amount of pressure. As the toner in the toner reservoir T is subjected to pressure, the bristles of the brush 40 are elastically deformed, expanding the gap X between the brush 40 and photosensitive drum 4Y. Consequently, the toner in the toner reservoir T is discharged from the toner reservoir T by an amount which is proportional to the amount by which the gap X, through which the interior of the toner reservoir T is in connection to the outside of the toner reservoir T, is expanded.

On the other hand, in a case where the amount by which toner was scraped away by the cleaning blade 9Y from the photosensitive drum 4Y is large, the toner having collected in the toner reservoir T is pressed by a relative large amount of pressure. Thus, the bristles of the brush 40 are elastically deformed more than in a case where the amount by which the toner was scraped away by the cleaning blade 9Y is relatively small. Consequently, the gap X between the brush 40 (bristles) and photosensitive drum 4Y expands greater. Further, the bristles of the brush 40 are made to deform also by the weight of the removed residual toner having collected in the toner reservoir T, further expanding the gap X. Therefore, in a case where the amount by which the toner was scraped away by the cleaning blade 9Y is relatively large, the toner in the toner reservoir T can be discharged from the toner reservoir T by a greater amount than in a case where the amount by which the residual toner is scraped away by the cleaning blade 9Y is smaller. Moreover, the toner in the toner reservoir T is more likely to be discharged through the gaps among the bristles of the brush 40.

As described above, in this embodiment, as the residual toner is scraped away from the photosensitive drum 4Y by the cleaning blade 9Y, and moves downward into the toner reservoir T in terms of the gravity direction, the removed residual toner having collected in the bottom portion of the toner reservoir T is discharged from the toner reservoir T. Further, as the bristles of the brush 40 are deformed, the gaps among the bristles of the brush 40 increase. Therefore, the removed residual toner having collected among the bristles is replaced by the fresh supply of removed residual toner. In addition, as the bristles of the brush 40 restore themselves back into the state in which they were before they were made to elastically deform, the toner in the toner reservoir T is stirred by the bristles. Therefore, it is possible that the toner in the toner reservoir T will flow in the toner reservoir T. Therefore, regardless of the amount by which the residual toner is removed by the cleaning blade 9Y from the photosensitive drum 4Y, the amount by which toner is supplied to the toner reservoir T roughly balances with the amount by which toner is discharged from the toner reservoir T. That is, the toner in the toner reservoir T is partially replaced while remaining stable in overall weight. Further, it is from the bottom side of the toner reservoir T in terms of the gravity direction that the toner in the toner reservoir T is discharged. Therefore, it is possible that the toner in the top portion of the toner reservoir T, that is, the toner in the adjacencies of the cleaning edge 90, will substantially move. In this embodiment, therefore, even if the amount by which the residual toner is removed from the photosensitive drum 4Y is substantial, the toner in the toner reservoir T is smoothly replaced while remaining stable in overall amount.

Embodiment 2

Figure 6:
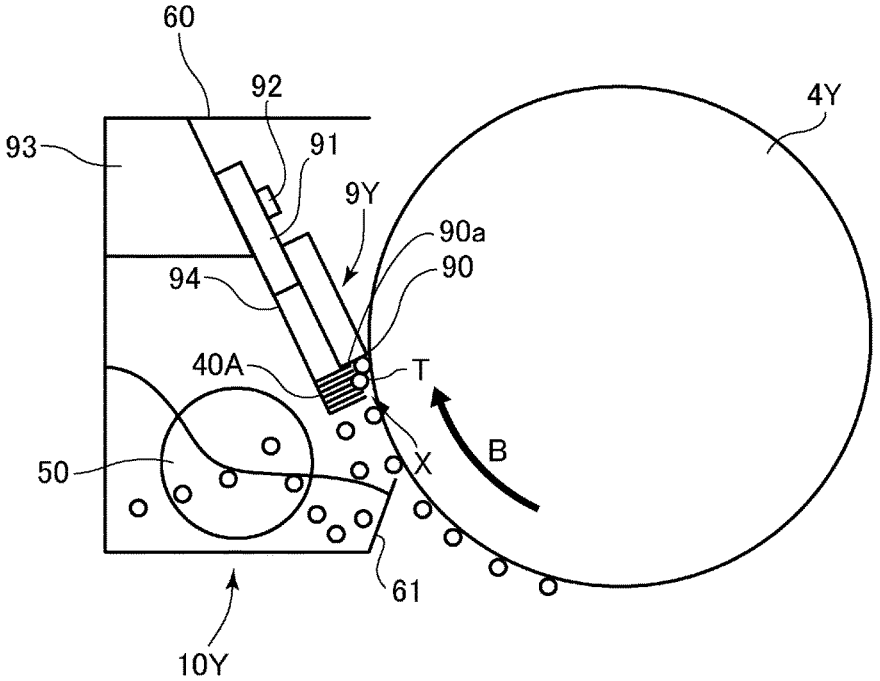
FIG. 6 is a sectional view of the cleaning device in the second embodiment of the present invention.

FIG. 6 shows the cleaning device in the second embodiment of the present invention. The components of the charging device in the second embodiment, which are similar in structure as the counterparts in the first embodiment are given the same referential codes as those given to the counterparts, and are not described here. The bristles of the brush 40A of the drum cleaning device 10Y shown in FIG. 6 are longer than the bristles of the brush 40 of the drum cleaning device 10Y shown in FIG. 3. They are long enough to cover a part of the end surface portion 9*a* of the cleaning blade 9Y. In this embodiment, therefore, the gap X between the cleaning blade 9Y (brush (bristles)) and photosensitive drum 4Y is smaller, making it easier for the removed residual toner to collect in the toner reservoir T, than in the first embodiment. This embodiment can provide the same effects as the first embodiment described above. The embodiment, however, can relatively quickly collect the toner in the toner reservoir T compared to the first embodiment. Therefore, it can reliably supply the cleaning edge 90 of the cleaning blade 9Y in the earlier stage of an image forming operation than the first embodiment.

Embodiment 3

Figure 7:
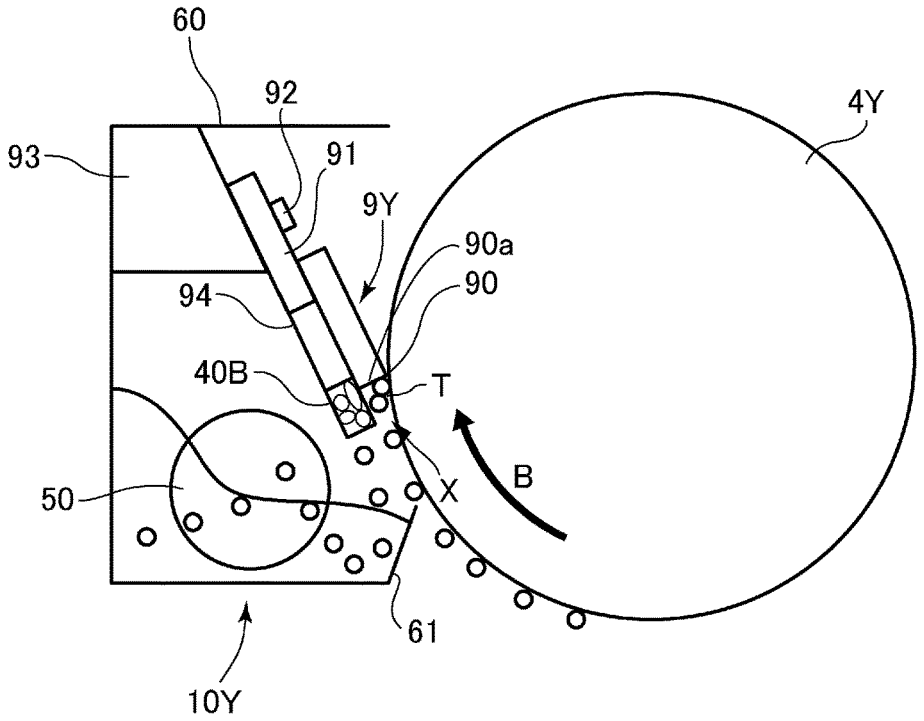
FIG. 7 is a sectional view of the cleaning device in the third embodiment.

FIG. 7 shows the cleaning device 10Y in the third embodiment of the present invention. The third embodiment is different from the first embodiment in that the drum cleaning device 10Y in the third embodiment is provided with a piece of sponge as the toner retaining member, in place of the brush 40 in the first embodiment. Otherwise, the drum cleaning device 10Y in this embodiment is the same in structure as the drum cleaning device 10Y in the first embodiment. More specifically, in the case of the drum cleaning device 10Y shown in FIG. 7, a piece of sponge 40B is attached to the opposite long edge portion of the sheet 40 from the blade supporting metallic plate 91. The sponge 40B, which is a porous member having a large number of pores, is attached to the sheet 94 so that a gap X is provided between itself and the photosensitive drum 4Y. Further, the drum cleaning device 10Y is structured so that the sponge 40B partially extends into the gap between the sheet 94 and cleaning blade 9Y to prevent the residual toner on the photosensitive drum 4Y from entering the space between the sheet 94 and cleaning blade 9Y as the toner is scraped down by the cleaning blade 9Y.

As the residual toner is scraped away from the photosensitive drum 4Y by the cleaning blade 9Y, the removed residual toner having collected in the toner reservoir T is pressed by the removed toner. Thus, the sponge 40B in this embodiment also deforms like the brush 40 in the first embodiment. Thus, the gap X between the sponge 40B and photosensitive drum 4Y expands, allowing the toner to be discharged from the toner reservoir T. As for the material for the sponge 40B, it may be any substance as long as it makes the sponge 40B less in rigidity than the cleaning blade 9Y. Further, the larger the sponge 40B in cell (pore) size, the better. Further, the greater the sponge 40B in cell (pore) count, the better. In this embodiment, urethane sponge (foamed urethane) which is 20-30 degrees in Asker C hardness scale, and roughly 60/inch in cell (pore) count, was used as the material for the sponge 40B. Using the sponge 40B as in this embodiment can provide the same effects as those provided by the above-described first embodiment in which the brush 40 was used.

Embodiment 4

Figure 8:
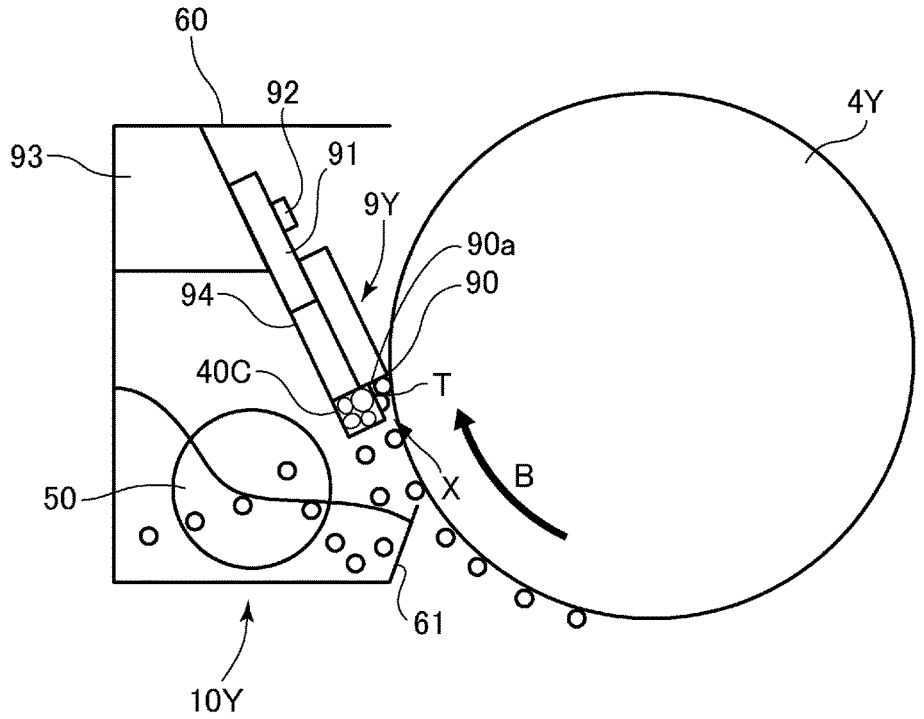
FIG. 8 is a sectional view of the cleaning device in the fourth embodiment.

FIG. 8 shows the drum cleaning device 10Y in the fourth embodiment of the present invention. By the way, the components of the drum cleaning device 10Y in this embodiment, which are the same in structure as the counterparts in the first embodiment, are given the same referential codes as those given to the counterparts, and are not described here. Compared to the drum cleaning device 10Y shown in FIG. 7, the sponge 40C of the drum cleaning device 10Y in this embodiment is thicker than the sponge 40B in the third embodiment, and covers a part of the end surface portion 90*a* of the cleaning blade 9Y. Thus, the gap X between the sponge 40C and photosensitive drum 4Y, in this embodiment, is narrower that the gap X between the sponge 40B and photosensitive drum 4Y in the third embodiment. Therefore, it is easier for the removed residual toner to collect in the toner reservoir T in this embodiment than in the third embodiment. The effects obtainable by this embodiment are the same as those obtainable by the above-described second embodiment, in which brush 40A was used.

[Miscellanies]

By the way, in each of the preceding embodiments, the drum cleaning device was provided with a combination of a sheet, and a brush or a piece of sponge, which was attached to the sheet. These embodiments, however, are not intended to limit the present invention in scope. That is, the combination can be anything, as long as it is less in rigidity than the cleaning blade 9Y, and is capable of expanding the gap X between itself and photosensitive drum by deforming in response to the pressure applied to the toner in the toner reservoir T.

Further, in each of the preceding embodiments, the image forming apparatus was structured so that four toner images, different in color, are transferred (primary transfer) from the photosensitive drums 4Y-4K, respectively, onto the intermediary transfer belt 2, and then, are transferred together (secondary transfer) onto a sheet P of recording medium. However, these embodiments are not intended to limit the present invention in scope. For example, the present invention is also applicable to an image forming apparatus of the so-called direct transfer type, which is structured so that the four toner images, different in color, are directly transferred onto a sheet P of recording medium from the photosensitive drums 4Y-4K, respectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-209894 filed on Oct. 26, 2015, which is hereby incorporated by reference herein in its entirety.

What is claimed is:

1. An image forming apparatus comprising:

a rotatable image bearing member configured to carry a toner image;

a cleaning blade configured to remove, with rotation of said image bearing member, toner remaining on said image bearing member, said cleaning blade including a supported portion supported by a supporting member and a free end portion, said cleaning blade contacting said image bearing member such that a direction from the supported portion toward an edge of the free end portion is opposite a peripheral movement direction of said image bearing member, and said cleaning blade further including a first surface opposed to said image bearing member and a second surface opposite from the first surface;

a toner retaining member cooperative with said image bearing member and configured to provide a toner accommodation space capable of accommodating the toner removed from said image bearing member by said cleaning blade, said toner retaining member being capable of retaining therein a part of the toner accommodated in the toner accommodation space and capable of being deformed by the toner accommodated in the toner accommodation space to discharge the toner from said toner accommodation space; and a supporting sheet opposed to and substantially parallel with the second surface of said cleaning blade with a gap therebetween, said supporting sheet having a first end portion supported at the supported portion of said cleaning blade and a second end portion projecting beyond the free end portion of said cleaning blade, wherein said supporting sheet supports said toner retaining member at a position adjacent to the second surface of said cleaning blade beyond the free end portion of said cleaning blade, such that a gap is provided between said toner retaining member and said image bearing member at a position where they are closest to each other.

2. An apparatus according to claim 1, wherein said toner retaining member is deformable to expand a gap between said toner accommodation space and an outside of said toner accommodation space.

3. An apparatus according to claim 1, wherein a stiffness of said supporting sheet is higher than that of said toner retaining member.

4. A apparatus according to claim 1, wherein said toner retaining member is provided such that said toner retaining member blocks an opening between said cleaning blade and said supporting sheet.

5. A apparatus according to claim 1, wherein said image bearing member is cylindrical, and said cleaning blade extends in a downward direction relative to said image bearing member to contact said image bearing member at a position above a level of a rotation axis of said image bearing member.

6. An apparatus according to claim 1, wherein said toner retaining member includes a brush comprising a plurality of resin material fibers.

7. An apparatus according to claim 1, wherein said toner retaining member includes a porous member having a plurality of pores.

* * * * *